US009629393B2

(12) United States Patent
Stolz et al.

(10) Patent No.: US 9,629,393 B2
(45) Date of Patent: Apr. 25, 2017

(54) SMOKING ARTICLE COMPRISING A COMBUSTIBLE HEAT SOURCE WITH A REAR BARRIER COATING

(71) Applicant: Philip Morris Products S.A., Neuchatel (CH)

(72) Inventors: Steffen Stolz, Greng (CH); Yvan Degoumois, Colombier (CH); Frederic Lavanchy, Grandson (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/356,215

(22) PCT Filed: Nov. 14, 2012

(86) PCT No.: PCT/EP2012/072557
§ 371 (c)(1),
(2) Date: May 5, 2014

(87) PCT Pub. No.: WO2013/072336
PCT Pub. Date: May 23, 2013

(65) Prior Publication Data

US 2014/0283860 A1 Sep. 25, 2014

(30) Foreign Application Priority Data

Nov. 15, 2011 (EP) ..... 11250893

(51) Int. Cl.
*A24F 47/00* (2006.01)
*A24B 15/16* (2006.01)

(52) U.S. Cl.
CPC ..... *A24F 47/006* (2013.01); *A24B 15/165* (2013.01); *A24F 47/004* (2013.01)

(58) Field of Classification Search
CPC .... A24F 47/004; A24F 47/008; A24F 47/006; A24B 15/165
See application file for complete search history.

(56) References Cited

U.S. PATENT DOCUMENTS 4,714,082 A 12/1987 Banerjee et al.
4,819,665 A * 4/1989 Roberts ..... A24F 47/004 131/194

(Continued)

FOREIGN PATENT DOCUMENTS

CN 86 1 05536 A 2/1987
CN 101778578 A 7/2010

(Continued)

OTHER PUBLICATIONS

Japanese Office Action mailed on Aug. 1, 2016 in corresponding Japanese Patent Application No. 2014-541632, with English translation, citing document AO therein (6 pages).

(Continued)

*Primary Examiner* — Anthony Calandra
(74) *Attorney, Agent, or Firm* — Oblon, McClelland, Maier & Neustadt, L.L.P.

(57) ABSTRACT

A smoking article is provided, including a combustible heat source with opposed front and rear faces and at least one airflow channel extending from the front face to the rear face of the combustible heat source, and an aerosol-forming substrate including at least one aerosol former downstream of the combustible heat source, wherein a non-metallic, non-combustible, gas-resistant, first barrier coating is provided on substantially all of the rear face of the combustible heat source.

14 Claims, 1 Drawing Sheet

(56) References Cited

U.S. PATENT DOCUMENTS

Figure 1:
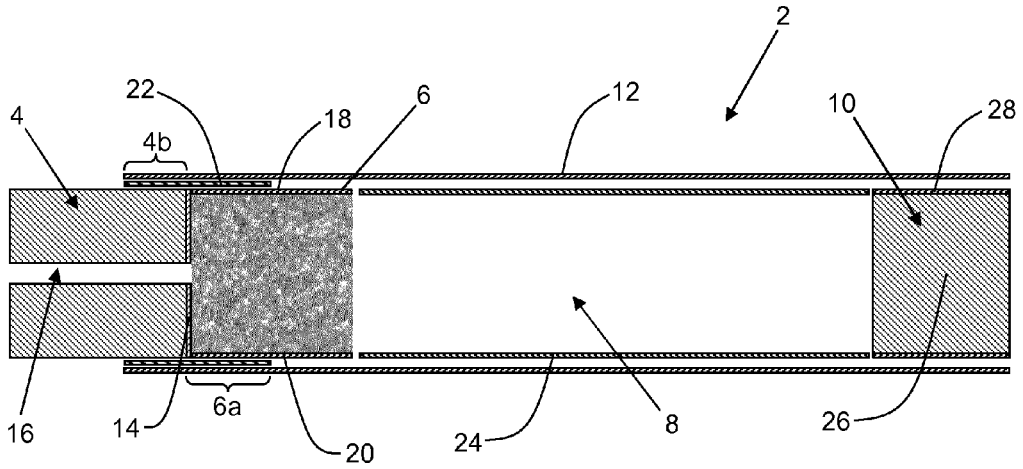

| | | | | |
|---|---|---|---|---|
| 5,040,551 | A | 8/1991 | Schlatter et al. | |
| 5,105,831 | A | 4/1992 | Banerjee et al. | |
| 5,156,170 | A | 10/1992 | Clearman et al. | |
| 5,468,266 | A * | 11/1995 | Bensalem | A24B 15/165 131/194 |
| 2006/0130862 | A1* | 6/2006 | Dittrich | A24B 15/16 131/364 |
| 2009/0065011 | A1 | 3/2009 | Maeder et al. | |
| 2012/0080042 | A1 | 4/2012 | Nishimura et al. | |

FOREIGN PATENT DOCUMENTS

| | | | |
|---|---|---|---|
| EP | 0 337 507 | A2 | 10/1989 |
| EP | 0 337 508 | A2 | 10/1989 |
| EP | 0 340 808 | | 11/1989 |
| JP | 04-501523 | | 3/1992 |
| RU | 2004 135 065 | A | 1/2006 |
| WO | 2009 022232 | | 2/2009 |
| WO | 2009 074870 | | 6/2009 |
| WO | WO 2010/146693 | A1 | 12/2010 |

OTHER PUBLICATIONS

Office Action issued Dec. 15, 2016 in Russian Patent Application No. 2014123692 (with English language translation).

Combined Chinese Office Action and Search Report issued Nov. 12, 2015 in Patent Application No. 201280051920.5 (with English language translation).

Extended European Search Report issued May 11, 2012 in Patent Application No. 11250893.2.

International Search Report Issued Jan. 31, 2013 in PCT/EP12/072557 Filed Nov. 14, 2012.

* cited by examiner

SMOKING ARTICLE COMPRISING A COMBUSTIBLE HEAT SOURCE WITH A REAR BARRIER COATING

CROSS REFERENCE TO RELATED APPLICATION

This application is a national phase application based on PCT/EP2012/072557, filed on Nov. 14, 2012.

The present invention relates to a smoking article comprising a combustible heat source and an aerosol-forming substrate comprising at least one aerosol-former, wherein the substrate is downstream of the combustible heat source, to a combustible heat source for use in such a smoking article, and to a method of reducing the formation of certain harmful smoke constituents during combustion of a combustible heat source in a smoking article.

A number of smoking articles in which tobacco is heated rather than combusted have been proposed in the art. The aim of such smoking articles is to reduce known harmful smoke constituents produced by the combustion and pyrolytic degradation of tobacco in conventional cigarettes. Typically in such smoking articles, an aerosol is generated by the transfer of heat from a combustible fuel element or heat source to an aerosol-forming substrate, which may be located within, around or downstream of the fuel element. During smoking, volatile compounds are released from the aerosol-forming substrate by heat transfer from the fuel element and entrained in air drawn through the smoking article. As the released compounds cool they condense to form an aerosol that is inhaled by the consumer.

For example, WO-A2-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate. In the smoking article of WO-A2-2009/022232, the surface of the aerosol-forming substrate is in direct contact with the combustible heat source.

A number of previous attempts have been made to reduce the amount of carbon monoxide produced during the combustion of carbonaceous heat sources for heatable smoking articles, such as by using catalysts in the heat source to convert carbon monoxide produced during combustion of the heat source to carbon dioxide. Other prior art documents, such as U.S. Pat. No. 5,040,551, disclose a method for reducing the amount of carbon monoxide produced in the combustion of a carbonaceous fuel element by coating some or all of the exposed surfaces of the carbonaceous fuel element with a thin, microporous layer of solid particulate matter which is substantially non-combustible at temperatures in which the carbonaceous fuel combusts. According to U.S. Pat. No. 5,040,551, the microporous layer must be sufficiently thin, and therefore permeable to air, so as not to unduly prevent the carbonaceous fuel from combusting. Like the smoking article of WO-A2-2009/022232, the surface of the aerosol-forming substrate in U.S. Pat. No. 5,040,551 is in direct contact with the combustible heat source.

To facilitate aerosol formation, the aerosol-forming substrates of known heatable smoking articles typically comprise a polyhydric alcohol such as glycerine or other known aerosol-formers. During storage and smoking, aerosol-formers may migrate from the aerosol-forming substrates of known heatable smoking articles to the combustible heat sources thereof. This migration of the aerosol-formers can disadvantageously lead to their decomposition, particularly during smoking of the heatable smoking articles. A number of previous attempts have been made to inhibit migration of aerosol-formers from the aerosol-forming substrates of heatable smoking articles to the combustible heat sources thereof (for example, in U.S. Pat. No. 4,714,082, EP-A2-0 337 507, EP-A2-0 337 508 and U.S. Pat. No. 5,156,170). Generally, such attempts have involved smoking articles in which the aerosol-forming substrate is enveloped within a non-combustible capsule, such as a metallic cage, to reduce migration of aerosol-formers from the aerosol-forming substrate to the combustible heat source during storage and use, but in which the combustible heat source is still allowed to come into direct contact with aerosol-formers from the aerosol-forming substrate during storage and use. Such prior art designs disadvantageously allow for decomposition and combustion gases generated from the combustible heat source to be directly drawn into the mainstream aerosol, make it difficult to use known machinery and methods to produce the smoking article, and can hinder the ability of the smoking article to attain a suitable temperature to provide a satisfactory aerosol during the first few puffs by the consumer.

There remains a need for an improved heatable smoking article comprising a combustible heat source and an aerosol-forming substrate comprising at least one aerosol-former which may be assembled using known manufacturing equipment. There also further remains a need for an improved heatable smoking article comprising a combustible heat source and an aerosol-forming substrate comprising at least one aerosol-former in which migration of the at least one aerosol-former from the aerosol-forming substrate to the combustible heat source is substantially prevented or inhibited. Further, there still is a need to reduce the level of harmful smoke constituents in the mainstream aerosol of a heatable smoking article, like carbonyl compounds, such as formaldehyde, acetaldehyde, proprionaldehyde, and phenolics.

According to the invention, there is provided a smoking article comprising: a combustible heat source with opposed front and rear faces and at least one airflow channel extending from the front face to the rear face of the combustible heat source; and an aerosol-forming substrate comprising at least one aerosol-former downstream of the combustible heat source. A non-metallic, non-combustible, gas-resistant, first barrier coating is provided on substantially the entire rear face of the combustible heat source, which allows gas to be drawn through the at least one airflow channel.

There is further provided a smoking article according to the invention, wherein the first barrier coating has a thickness of at least about 10 microns.

There is further provided a smoking article according to the invention, wherein the first barrier coating is substantially impermeable to air.

There is further provided a smoking article according to the invention, wherein the first barrier coating comprises clay, glass, or alumina.

There is further provided a smoking article according to the invention, wherein the combustible heat source is a carbonaceous heat source.

There is further provided a smoking article according to the invention, wherein the combustible heat source comprises an ignition aid.

There is further provided a smoking article according to the invention, wherein the ignition aid is an oxidizing agent.

There is further provided a smoking article according to the invention, wherein a gas-resistant, heat resistant, second barrier coating is provided on the inner surface of the at least one airflow channel.

There is further provided a smoking article according to the invention, wherein the second barrier coating is substantially impermeable to air.

There is further provided a smoking article according to the invention, wherein the aerosol-forming substrate comprises homogenised tobacco-based material.

There is further provided a smoking article according to the invention, further comprising a heat-conducting element around and in contact with a rear portion of the combustible heat source and an adjacent front portion of the aerosol-forming substrate.

There is further provided a smoking article according to the invention, further comprising an expansion chamber downstream of the aerosol-forming substrate.

There is further provided a smoking article according to the invention, further comprising a mouthpiece downstream of the expansion chamber.

According to the invention there is also provided a combustible heat source with opposed front and rear faces for use in a smoking article according to the invention having a non-metallic, non-combustible, gas-resistant, first barrier coating provided on substantially the entire rear face thereof.

According to the invention, there is provided a smoking article for lowering the amount of carbon monoxide produced during combustion of a combustible heat source in the smoking article.

According to the invention, there is provided a smoking article for lowering the amount of certain harmful smoke constituents, such as carbon monoxide, formaldehyde, acetaldehyde, proprionaldehyde and phenolics, which are produced during combustion of a combustible heat source in the smoking article.

According to the invention, there is provided a combustible heat source for lowering the amount of certain harmful smoke constituents, such as carbon monoxide, formaldehyde, acetaldehyde, proprionaldehyde and phenolics, which are produced during combustion of the combustible heat source in a smoking article.

According to the invention, there is provided a method to reduce the formation of gas, selected from the group consisting of carbon monoxide, formaldehyde, acetaldehyde, proprionaldehyde, phenolics and mixtures thereof that is generated in mainstream aerosol during combustion of a combustible heat source in a smoking article, comprising the step of forming a smoking article according to the invention.

As used herein, the terms 'upstream' and 'front', and 'downstream' and 'rear', are used to describe the relative positions of components, or portions of components, of combustible heat sources and smoking articles according to the invention in relation to the direction of air drawn through the combustible heat sources and smoking articles during use thereof.

As used herein, the term 'coating' is used to describe a layer of material that covers and is adhered to the heat source.

As used herein, the term 'non-metallic' is used to describe a barrier coating that is not formed primarily from an elemental metal or alloy, that is a barrier coating having an elemental metal or alloy content of less than 50 mole percent.

As used herein, the term 'non-combustible' is used to describe a barrier coating that is substantially non-combustible at temperatures reached by the combustible heat source during combustion or ignition thereof.

As used herein, the term 'gas-resistant' is used to describe a barrier coating that is at least substantially impermeable to gas. Preferably, the first barrier coating is at least substantially impermeable to air.

As used herein, the term 'aerosol-forming substrate' is used to describe a substrate capable of releasing upon heating volatile compounds, which can form an aerosol.

The provision of a non-metallic, non-combustible, gas-resistant, first barrier coating on substantially the entire rear face of the combustible heat source advantageously prevents or inhibits migration of the at least one aerosol-former from the aerosol-forming substrate to the combustible heat source during storage and use of smoking articles according to the invention. Decomposition of the at least one aerosol-former during use of smoking articles according to the invention is thus advantageously avoided or reduced.

The provision of a non-metallic, non-combustible, gas-resistant, first barrier coating on substantially the entire rear face of the combustible heat source also advantageously may limit or prevent migration of other volatile components of the aerosol-forming substrate from the aerosol-forming substrate to the combustible heat source during storage and during use of smoking articles according to the invention.

The non-metallic, non-combustible, gas-resistant, first barrier coating provided on the rear face of the combustible heat source also advantageously prevents or inhibits combustion and decomposition products formed during ignition and combustion of the combustible heat source from entering air drawn through the smoking article during use thereof. As described further below, this is particularly advantageous where the combustible heat source comprises one or more additives to aid ignition or combustion of the combustible heat source or a combination thereof.

The non-metallic, non-combustible, gas-resistant, first barrier coating provided on the rear face of the combustible heat source also advantageously limits the temperature to which the aerosol-forming substrate is exposed during ignition or combustion of the combustible heat source, and so helps to avoid thermal degradation or combustion of the aerosol-forming substrate during use of the smoking article. As described further below, this is also particularly advantageous where the combustible heat source comprises one or more additives to aid ignition of the combustible heat source.

Depending upon the desired characteristics and performance of the smoking article, the non-metallic, non-combustible, gas-resistant, first barrier coating may have a low or high thermal conductivity. In one example of the preferred embodiment, the non-metallic, non-combustible, gas-resistant, first barrier coating may be formed from material having a bulk thermal conductivity of between about 0.1 W per metre Kelvin (W/(m·K)) and about 200 W per metre Kelvin (W/(m·K)) at 23° C. and a relative humidity of 50% as measured using the modified transient plane source (MTPS) method. In another example of the preferred embodiment, the non-metallic, non-combustible, gas-resistant, first barrier coating may be formed from material having a bulk thermal conductivity of between about 0.05 W per metre Kelvin (W/(m·K)) and about 50 W per metre Kelvin (W/(m·K)) at 23° C. and a relative humidity of 50% as measured using the modified transient plane source (MTPS) method.

The thickness of the non-metallic, non-combustible, gas-resistant, first barrier coating may be appropriately adjusted to achieve good smoking performance while avoiding or minimizing one or both of the generation and intake of harmful volatile compounds from the smoking article. In one example of the preferred embodiment, the non-metallic, non-combustible, gas-resistant, first barrier coating may have a thickness of between about 10 microns and about 500 microns.

The non-metallic, non-combustible, gas-resistant, first barrier coating may be formed from one or more suitable materials that are substantially thermally stable and non-combustible at temperatures achieved by the combustible heat source during ignition and combustion. Suitable materials are known in the art and include, but are not limited to, clays (such as for example bentonite and kaolinite), glasses and other minerals, ceramic materials or combinations thereof.

Preferred coating materials from which the non-combustible, gas-resistant, first barrier coating may be formed include clays and glasses. More preferably, the non-metallic, non-combustible, gas-resistant, first barrier coating may be formed from alumina ($Al_2O_3$), resins, and mineral glues. In one preferred embodiment of the invention, the non-metallic, non-combustible, gas-resistant, first barrier coating is a clay coating comprising a 50/50 mixture of bentonite and kaolinite. In another preferred embodiment of the invention, the non-metallic, non-combustible, gas-resistant, first barrier coating is a glass coating, more preferably a sintered glass coating.

Preferably, the non-metallic, non-combustible, gas-resistant, first barrier coating has a thickness of at least about 10 microns. Due to the slight permeability of clays to gas, in embodiments where the non-metallic, non-combustible, gas-resistant, first barrier coating is a clay coating the non-metallic, non-combustible, gas-resistant, first barrier coating more preferably has a thickness of at least about 50 microns, and most preferably of between about 50 microns and about 350 microns. In embodiments where the non-metallic, non-combustible, gas-resistant, first barrier coating is formed from one or more materials that are more impervious to gas, the non-metallic, non-combustible, gas-resistant, first barrier coating may be thinner, and generally will preferably have a thickness of less than about 100 microns, and more preferably about 20 microns. In embodiments where the non-metallic, non-combustible, gas-resistant, first barrier coating is a glass coating, the non-metallic, non-combustible, gas-resistant, first barrier coating preferably has a thickness under 200 microns. The thickness of the non-metallic, non-combustible, gas-resistant, first barrier coating may be measured using a microscope, a scanning electron microscope (SEM) or any other suitable measurement methods known in the art.

The non-metallic, non-combustible, gas-resistant, first barrier coating may be applied to cover and adhere to substantially the entire rear face of the combustible heat source by any suitable methods known in the art including, but not limited to, spray-coating, vapour deposition, dipping, material transfer (for example, brushing or gluing), electrostatic deposition or any combination thereof.

The non-metallic, non-combustible, gas-resistant, first barrier coating, for example, may be made by pre-forming a barrier in the approximate size and shape of the rear face of the combustible heat source, and applying it to the rear face of the combustible heat source to cover and adhere to substantially the entire rear face of the combustible heat source. Alternatively, the non-metallic, non-combustible, gas-resistant, first barrier coating may be formed, drilled or machined after it is applied to the rear face of the combustible heat source.

In a preferred embodiment, the non-metallic, non-combustible, gas-resistant, first barrier coating is formed by applying a solution or suspension of one or more suitable coating materials to the rear face of the combustible heat source. For example, the non-metallic, non-combustible, gas-resistant, first barrier coating may be applied to substantially the entire rear face of the combustible heat source by dipping the rear face of the combustible heat source in a solution or suspension of one or more suitable coating materials or by brushing or spray-coating a solution or suspension or electrostatically depositing a powder or powder mixture of one or more suitable coating materials onto the rear face of the combustible heat source. The rear face of the combustible heat source is preferably pre-treated with water glass before electrostatic deposition. More preferably, the non-combustible, gas-resistant, first barrier coating is applied by spray-coating.

The non-metallic, non-combustible, gas-resistant, first barrier coating may be formed through a single application of a solution or suspension of one or more suitable coating materials to the rear face of the combustible heat source. Alternatively, the non-metallic, non-combustible, gas-resistant, first barrier coating may be formed through multiple applications of a solution or suspension of one or more suitable coating materials to the rear face of the combustible heat source. For example, the non-metallic, non-combustible, gas-resistant, first barrier coating may be formed through one, two, three, four, five, six, seven or eight successive applications of a solution or suspension of one or more suitable coating materials to the rear face of the combustible heat source.

Preferably, the non-metallic, non-combustible, gas-resistant, first barrier coating is formed through between one and ten applications of a solution or suspension of one or more suitable coating materials to the rear face of the combustible heat source.

After application of the solution or suspension of one or more coating materials to the rear face thereof, the combustible heat source may be dried to form the non-metallic, non-combustible, gas-resistant, first barrier coating.

Where the non-metallic, non-combustible, gas-resistant, first barrier coating is formed through multiple applications of a solution or suspension of one or more suitable coating materials to the rear face thereof, the combustible heat source may need to be dried between successive applications of the solution or suspension.

Alternatively or in addition to drying, after application of a solution or suspension of one or more coating materials to the rear face of the combustible heat source, the one or more coating materials on the combustible heat source may be sintered in order to form the non-metallic, non-combustible, gas-resistant, first barrier coating. Sintering of the non-metallic, non-combustible, gas-resistant, first barrier coating is particularly preferred where the barrier coating is a glass or ceramic coating.

Preferably, the non-metallic, non-combustible, gas-resistant, first barrier coating is sintered at a temperature of between about 500° C. and about 900° C., and more preferably at about 700° C.

Preferably, the combustible heat source is a carbonaceous heat source. As used herein, the term 'carbonaceous' is used to describe a heat source comprising carbon.

Preferably, the combustible heat source is a carbon-based heat source. As used herein, the term 'carbon-based' is used to describe a heat source comprising primarily carbon, that is a heat source having a carbon content of at least 50 percent by dry weight. Preferably, combustible carbon-based heat sources according to the invention have a carbon content of at least about 60 percent by dry weight, more preferably of at least about 70 percent by dry weight, most preferably of at least about 80 percent by dry weight.

Combustible carbonaceous heat sources according to the invention may be formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In a particularly preferred embodiment of the invention, the combustible heat source is formed from a mixture of carbon powder, modified cellulose, flour and sugar.

Instead of, or in addition to one or more binders, combustible heat sources according to the invention may comprise one or more additives in order to improve the properties of the combustible carbonaceous heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, and/or zirconium), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Such additives may be incorporated in the combustible heat source prior to or after application of the non-metallic, non-combustible, gas-resistant, first barrier coating to the rear surface thereof.

In a particularly preferred embodiment, the combustible heat source is a cylindrical combustible heat source comprising carbon and at least one ignition aid, the cylindrical combustible heat source having an upstream end face and an opposed downstream end face, wherein at least part of the cylindrical combustible heat source between the upstream end face and the downstream end face is wrapped in a combustion resistant wrapper and wherein upon ignition of the upstream end face of the cylindrical combustible heat source the downstream end face of the cylindrical combustible heat source increases in temperature to a first temperature and wherein during subsequent combustion of the cylindrical combustible heat source the downstream end face of the cylindrical combustible heat source maintains a second temperature lower than the first temperature. As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' also is used to describe an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion.

In use the release of one or both of energy and oxygen by the at least one ignition aid during ignition of the combustible heat source results in a boost in temperature of the combustible heat source upon ignition thereof. This is reflected in an increase in temperature of the combustible heat source. In use in a smoking article according to the invention, this advantageously ensures that sufficient heat is available to be transferred from the combustible heat source to the aerosol-forming substrate of the smoking article and so facilitates production of an acceptable aerosol during early puffs thereof.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; carbonates; iodates; periodates; iodites; sulphates; sulfites; other sulfoxides; phosphates; phospinates; phosphites; and phosphanites.

While advantageously improving the ignition and combustion properties of the combustible heat source, the inclusion of ignition and combustion additives can give rise to undesirable decomposition and reaction products during use of the smoking article. For example, decomposition of nitrates included in the combustible heat source to aid ignition thereof can result in the formation of nitrogen oxides. The non-metallic, non-combustible, gas-resistant, first barrier coating provided on the rear face of the combustible heat source advantageously prevents or inhibits such decomposition and reaction products from entering air drawn through the smoking article during use thereof.

In addition, the inclusion of oxidisers, such as nitrates or other additives to aid ignition can result in generation of hot gases and high temperatures in the combustible heat source during ignition of the combustible heat source. By acting as a heat sink and barrier to the hot gases, the non-metallic, non-combustible, gas-resistant, first barrier coating provided on the rear face of the combustible heat source advantageously limits the temperature to which the aerosol-forming substrate is exposed, and so helps to avoid thermal degradation or combustion of the aerosol-forming substrate during ignition of the combustible heat source.

To form combustible carbonaceous heat sources according to the invention, one or more carbon-containing materials is preferably mixed with the one or more binders and other additives, where included, and pre-formed into a desired shape. The mixture of one or more carbon containing materials, one or more binders and other additives may be pre-formed into a desired shape using any suitable known ceramic forming methods such as, for example, slip casting, extrusion, injection moulding and die compaction. Preferably, the mixture is pre-formed into a desired shape by extrusion.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. Preferably, the elongate rod or other desired shape is pyrolysed in a nitrogen atmosphere at a temperature of between about 700° C. and about 900° C.

In one embodiment, at least one metal nitrate salt is incorporated in the combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In preferred embodiments of the invention, exposure of the combustible heat source to a conventional yellow flame lighter or other ignition means should cause the at least one metal nitrate salt to decompose and release oxygen and energy. This decomposition causes an initial boost in the temperature of the combustible heat source and also aids in the ignition of the combustible heat source. Following decomposition of the at least one metal nitrate salt, the combustible heat source preferably continues to combust at a lower temperature.

The inclusion of at least one metal nitrate salt advantageously results in ignition of the combustible heat source being initiated internally, and not only at a point on the surface thereof. Preferably, the at least one metal nitrate salt is distributed substantially homogeneously throughout the combustible heat source. Preferably, the at least one metal nitrate salt is present in the combustible heat source in an amount of between about 20 percent by dry weight and about 50 percent by dry weight of the combustible heat source.

In another embodiment of the invention, the combustible heat source comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible heat source to a conventional yellow flame lighter or other ignition means should cause the at least one peroxide or superoxide to decompose and release oxygen. This causes an initial boost in the temperature of the combustible heat source and also aids in the ignition of the combustible heat source. Following decomposition of the at least one peroxide or superoxide, the combustible heat source preferably continues to combust at a lower temperature.

The inclusion of at least one peroxide or superoxide advantageously results in ignition of the combustible heat source being initiated internally, and not only at a point on the surface thereof. Preferably, the at least one peroxide or superoxide is distributed substantially homogeneously throughout the combustible heat source.

The combustible heat source preferably has a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of combustible heat sources according to the invention using conventional methods and technology.

Advantageously, combustible carbonaceous heat sources according to the invention have an apparent density of between about 0.6 $g/cm^3$ and about 1 $g/cm^3$.

Preferably, the combustible heat source has a mass of between about 300 mg and about 500 mg, more preferably of between about 400 mg and about 450 mg.

Preferably, the combustible heat source has a length of between about 7 mm and about 17 mm, more preferably of between about 11 mm and about 15 mm, most preferably of about 11 mm.

As used herein, the term 'length' denotes the dimension in the longitudinal direction of the combustible heat source.

Preferably, the combustible heat source has a diameter of between about 5 mm and about 9 mm, more preferably of between about 7 mm and about 8 mm.

Preferably, the combustible heat source is of substantially uniform diameter. However, the combustible heat source may alternatively be tapered so that the diameter of the rear portion of the combustible heat source is greater than the diameter of the front portion thereof. Particularly preferred are combustible heat sources that are substantially cylindrical. The combustible heat source may, for example, be a cylinder or tapered cylinder of substantially circular cross-section or a cylinder or tapered cylinder of substantially elliptical cross-section.

The combustible heat source comprises at least one airflow channel, preferably passing through an inner portion of the combustible heat source and extending along the entire length of the combustible heat source. Alternatively or in addition, the combustible heat source may comprise at least one airflow channel extending along the external periphery of the combustible heat source. Combustible heat sources according to one preferred embodiment of the invention comprise one, two or three airflow channels. Most preferably, a single airflow channel is provided through combustible heat sources according to the invention. In particularly preferred embodiments of the invention, the combustible heat source comprises a single substantially central or axial airflow channel. The diameter of the single airflow channel is preferably between about 1.5 mm and about 3 mm. The non-metallic, non-combustible, gas-resistant, first barrier coating, which covers substantially the entire rear face of the combustible heat source, allows gas to be drawn through at least one of the airflow channel of the combustible heat source from the upstream end face of the smoking article.

The inner surface of the at least one airflow channel of the combustible heat source may be partially or entirely coated with a second barrier coating. Preferably, the second barrier coating covers substantially the entire inner surface of all airflow channels of the combustible heat source.

Preferably, the second barrier coating comprises a layer of solid particulate matter that is gas-resistant. More preferably, the second barrier coating is at least substantially impermeable to air. Advantageously, the gas-resistant second barrier coating is of low thermal conductivity.

The second barrier coating may be formed from one or more suitable materials that are substantially thermally stable and non-combustible at temperatures achieved by the combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof. Preferred coating materials from which the second barrier coating may be formed include clays, glass, aluminium, iron oxide and combinations thereof. If desired, catalytic ingredients, such as ingredients that promote the oxidation of carbon monoxide to carbon dioxide, may be incorporated in the second barrier coating. Suitable catalytic ingredients include, but are not limited to, for example, platinum, palladium, transition metals and their oxides.

The second barrier coating may be formed from the same or different material or materials as the non-combustible, gas-resistant, first barrier coating.

Preferably, the second barrier coating has a thickness of between about 30 microns and about 200 microns, more preferably of between about 30 microns and about 100 microns.

The second barrier coating may be applied to the inner surface of the at least one airflow channel of the combustible heat source by any suitable method, such as the methods described in U.S. Pat. No. 5,040,551. For example, the inner surface of each airflow channel may be sprayed, wetted or painted with a solution or a suspension of the second barrier coating. Alternatively, the second barrier coating may be provided by insertion of a liner into one or more airflow channels. For example, a gas-resistant hollow tube may be inserted into each airflow channel.

In a preferred embodiment, the second barrier coating is applied to the inner surface of the at least one airflow channel of the combustible heat source by the process described in WO-A2-2009/074870 as the combustible heat source is extruded.

Optionally, the combustible heat source may comprise one or more, preferably up to and including six, longitudinal grooves that extend along part of or all of the periphery of the combustible heat source. If desired, the combustible heat source may comprise at least one airflow channel and one or more longitudinal grooves.

Combustible heat sources with opposed front and rear faces according to the invention having a non-metallic, non-combustible, gas-resistant, first barrier coating provided on substantially the entire rear face thereof are particularly suited for use in smoking articles of the type disclosed in WO-A-2009/022232. However, it will be appreciated that combustible heat sources according to the invention may also be used in smoking articles having different constructions and compositions.

Preferably, the combustible heat source and the aerosol-forming substrate abut one another.

Preferably, smoking articles according to the invention further comprise a heat-conducting element around and in contact with a rear portion of the combustible heat source and an adjacent front portion of the aerosol-forming substrate. The heat-conducting element is preferably combustion resistant and oxygen restricting.

Suitable heat-conducting elements for use in the invention include, but are not limited to: metal foil wrappers such as, for example, aluminium foil wrappers, steel wrappers, iron foil wrappers and copper foil wrappers; and metal alloy foil wrappers.

Preferably, the rear portion of the combustible heat source surrounded by the heat-conducting element is between about 2 mm and about 8 mm in length, more preferably between about 3 mm and about 5 mm in length.

Preferably, the front portion of the combustible heat source not surrounded by the heat-conducting element is between about 5 mm and about 15 mm in length, more preferably between about 6 mm and about 8 mm in length.

Preferably, the aerosol-forming substrate extends at least about 3 mm downstream beyond the heat-conducting element.

Preferably, the aerosol-forming substrate has a length of between about 5 mm and about 20 mm, more preferably of between about 8 mm and about 12 mm. Preferably, the front portion of the aerosol-forming substrate surrounded by the heat-conducting element is between about 2 mm and about 10 mm in length, more preferably between about 3 mm and about 8 mm in length, most preferably between about 4 mm and about 6 mm in length. Preferably, the rear portion of the aerosol-forming substrate not surrounded by the heat-conducting element is between about 3 mm and about 10 mm in length. In other words, the aerosol-forming substrate preferably extends between about 3 mm and about 10 mm downstream beyond the heat-conducting element. More preferably, the aerosol-forming substrate extends at least about 4 mm downstream beyond the heat-conducting element.

Preferably, aerosol-forming substrates of smoking articles according to the invention comprise at least one aerosol-former and a material capable of emitting volatile compounds in response to heating. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in the smoking articles according to the invention are polyhydric alcohols or mixtures thereof, such as triethylene glycol, 1,3-butanediol and, most preferred, glycerine.

Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. Preferably, the plant-based material consists essentially of tobacco material, most preferably homogenised tobacco material.

Smoking articles according to the invention preferably further comprise an expansion chamber downstream of the aerosol-forming substrate. The inclusion of an expansion chamber advantageously allows further cooling of the aerosol generated by heat transfer from the combustible heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

Smoking articles according to the invention may also further comprise a mouthpiece downstream of the aerosol-forming substrate and, where present, downstream of the expansion chamber. The mouthpiece may, for example, comprise a filter made of cellulose acetate, paper or other suitable known filtration materials. Preferably, the mouthpiece is of low filtration efficiency, more preferably of very low filtration efficiency. Alternatively or in addition, the mouthpiece may comprise one or more segments comprising absorbents, adsorbents, flavourants, and other aerosol modifiers and additives which are used in filters for conventional cigarettes, or combinations thereof.

Smoking articles according to the invention may be assembled using known methods and machinery.

Figure 2:
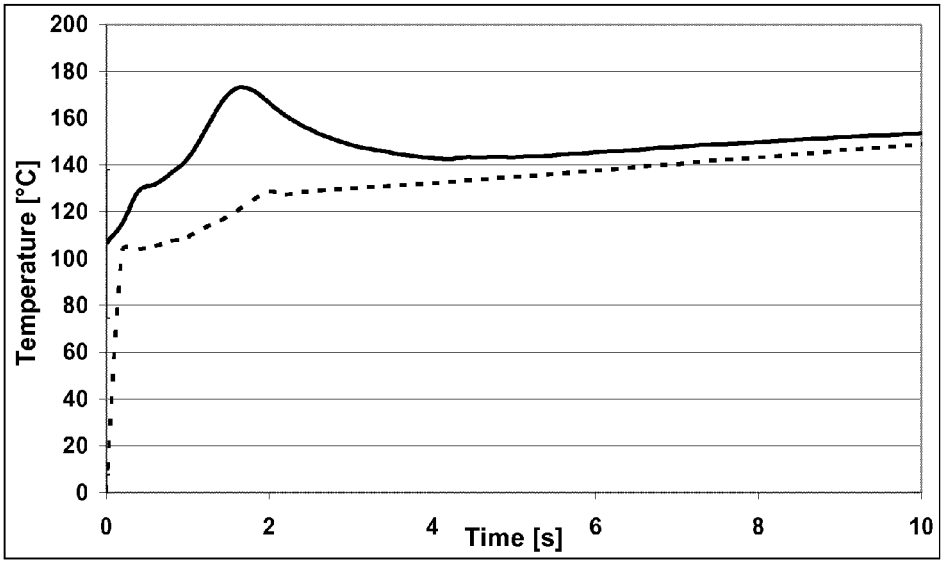

The invention will be further described, by way of example only, with reference to the accompanying drawing in which:

FIG. 1 shows a schematic longitudinal cross-section of a smoking article according to a preferred embodiment of the invention; and FIG. 2 shows a graph of the temperature of the aerosol-forming substrate of a smoking article according to the first embodiment of the invention during combustion of the combustible heat source thereof.

The smoking article 2 shown in FIG. 1 comprises a combustible carbonaceous heat source 4 according to the invention, an aerosol-forming substrate 6, an elongate expansion chamber 8 and a mouthpiece 10 in abutting coaxial alignment. The combustible carbonaceous heat source 4, aerosol-forming substrate 6, elongate expansion chamber 8 and mouthpiece 10 are overwrapped in an outer wrapper of cigarette paper 12 of low air permeability.

As shown in FIG. 1, a non-metallic, non-combustible, gas-resistant, first barrier coating 14 is provided on substantially the entire rear face of the combustible carbonaceous heat source 4.

The combustible carbonaceous heat source 4 comprises a central airflow channel 16 that extends longitudinally through the combustible carbonaceous heat source 4 and the non-metallic, non-combustible, gas-resistant, first barrier coating 14. A gas-resistant, heat resistant, second barrier coating (not shown) is provided on the inner surface of the central airflow channel 16.

The aerosol-forming substrate 6 is located immediately downstream of the combustible carbonaceous heat source 4 and comprises a cylindrical plug of tobacco material 18 comprising glycerine as aerosol former and circumscribed by filter plug wrap 20.

A heat-conducting element 22 consisting of a tube of aluminium foil surrounds and is in contact with a rear portion 4*b* of the combustible carbonaceous heat source 4 and an abutting front portion 6*a* of the aerosol-forming substrate 6. As shown in FIG. 1, a rear portion of the aerosol-forming substrate 6 is not surrounded by the heat-conducting element 22.

The elongate expansion chamber 8 is located downstream of the aerosol-forming substrate 6 and comprises a cylindrical open-ended tube of cardboard 24. The mouthpiece 10 of the smoking article 2 is located downstream of the expansion chamber 8 and comprises a cylindrical plug of cellulose acetate tow 26 of very low filtration efficiency circumscribed by filter plug wrap 28. The mouthpiece 10 may be circumscribed by tipping paper (not shown).

In use, the consumer ignites the combustible carbonaceous heat source 4 and then draws air through the central airflow channel 16 downstream towards the mouthpiece 10. The front portion 6*a* of the aerosol-forming substrate 6 is heated primarily by conduction through the abutting non-combusting rear portion 4*b* of the combustible carbonaceous heat source 4 and the heat-conducting element 22. The drawn air is heated as it passes through the central airflow channel 16 of the combustible carbonaceous heat source 4 and then heats the aerosol-forming substrate 6 by convection. The heating of the aerosol-forming substrate 6 releases volatile and semi-volatile compounds and glycerine from the aerosol-forming substrate 18, which are entrained in the heated drawn air as it flows through the aerosol-forming substrate 18. The heated air and entrained compounds pass downstream through the expansion chamber 8, cool and condense to form an aerosol that passes through the mouthpiece 10 into the mouth of the consumer (at about ambient temperature).

To assemble the smoking article 2, a rectangular piece of the heat-conducting element 22 is glued to cigarette paper 12. The combustible carbonaceous heat source 4, the plug of the aerosol-forming substrate 6 and the expansion chamber 8 are suitably aligned and positioned on the cigarette paper 12 with the attached heat-conducting element 22. The cigarette paper 12 with the attached heat-conducting element 22 is wrapped around the rear portion 4*b* of the combustible carbonaceous heat source 4, the aerosol-forming substrate 6 and the expansion chamber 8 and glued. The mouthpiece 10 is attached to the open end of the expansion chamber using known filter combining technology.

Smoking articles according to the preferred embodiment of the invention shown in FIG. 1 having the dimensions shown in Table 1 were assembled using combustible carbonaceous heat sources produced in accordance with Example 1 and 6 below.

EXAMPLE 1

Preparation of Combustible Heat Source

Combustible cylindrical carbonaceous heat sources according to the invention may be prepared as described in WO2009/074870 A2 or any other prior art that is known to persons of ordinary skill in the art. An aqueous slurry, as described in WO2009/074870 A2, is preferably extruded through a die having a central die orifice of circular cross-section to make the combustible heat source. Preferably, the die orifice has a diameter of 8.7 mm so as to form cylindrical rods, preferably having a length of between about 20 cm and about 22 cm and a diameter of between about 9.1 cm and about 9.2 mm. A single longitudinal airflow channel may be formed in the cylindrical rods by a mandrel mounted centrally in the die orifice. The mandrel preferably has a circular cross-section with an outer diameter of approximately 2 mm or approximately 3.5 mm. Alternatively, three airflow channels may be formed in the cylindrical rods using three mandrels of circular cross-section with an outer diameter of approximately 2 mm mounted at regular angles in the die orifice. During extrusion of the cylindrical rods, a clay-based coating slurry (made using clay, such as natural green clay) may be pumped through a feed passageway extending through the centre of the mandrel or mandrels to form a thin second barrier coating of about 150 microns to about 300 microns on the inner surface of the airflow channel or channels. The cylindrical rods may be dried at a temperature of about 20° C. to about 25° C. under about 40% to about 50% relative humidity for between approximately 12 hours to approximately 72 hours and then pyrolysed in a nitrogen atmosphere at about 750° C. for approximately 240 minutes. After pyrolysis, the cylindrical rods can be cut and shaped to a defined diameter using a grinding machine to form individual combustible-carbonaceous heat sources. The rods after cutting and shaping preferably have a length of about 11 mm, a diameter of about 7.8 mm and a dry mass of about 400 mg. Individual combustible carbonaceous heat sources may be subsequently dried at about 130° C. for approximately 1 hour.

TABLE 1

| Smoking article | |
|---|---|
| Overall length (mm) | 70 |
| Diameter (mm) | 7.9 |
| Porous carbonaceous heat source | |
| Length (mm) | 11 |
| Diameter (mm) | 7.8 |
| Diameter of airflow channel (mm) | 1.85-3.50 |
| Thickness of first barrier coating (microns) | 0-500 |
| Thickness of second barrier coating (microns) | 0-300 |
| Aerosol-forming substrate | |
| Length (mm) | 10 |
| Diameter (mm) | 7.8 |
| Density (g/cm$^3$) | 0.8 |
| Aerosol former | Glycerine |
| Amount of aerosol former | 20% by dry wt. of tobacco |
| Expansion chamber | |
| Length (mm) | 42 |
| Diameter (mm) | 7.8 |
| Mouthpiece | |
| Length (mm) | 7 |
| Diameter (mm) | 7.8 |
| Heat-conducting element | |
| Length (mm) | 9 |
| Diameter (mm) | 7.8 |
| Thickness of aluminium foil (microns) | 20 |
| Length of the rear portion of the combustible carbonaceous heat | 4 |
| Length of the front portion of the aerosol-forming substrate (mm) | 5 |
| Length of the rear portion of the aerosol-forming substrate (mm) | 5 |

TABLE 1-continued

EXAMPLE 2

Coating of Combustible Heat Source with Bentonite/Kaolinite

A non-metallic, non-combustible, gas-resistant, first barrier coating of bentonite/kaolinite may be provided on the rear face of a combustible carbonaceous heat source prepared as described in Example 1 by dipping, brushing or spray coating. Dipping involves inserting the rear face of the combustible carbonaceous heat source into a concentrated bentonite/kaolinite solution. Preferably, the bentonite/kaolinite solution for dipping contains 3.8% bentonite, 12.5% kaolinite and 83.7% $H_2O$ [m/m]. The rear face of the combustible carbonaceous heat source is preferably dipped into the bentonite/kaolinite solution for about 1 second and the meniscus allowed to disappear as the result of penetration of the solution into the carbon pores at the surface of the rear face of the combustible carbonaceous heat source. Brushing involves dipping a brush into a concentrated bentonite/kaolinite solution and applying the concentrated bentonite/kaolinite solution on the brush to the surface of the rear face of the combustible carbonaceous heat source until covered. The bentonite/kaolinite solution for brushing preferably contains 3.8% bentonite, 12.5% kaolinite and 83.7% $H_2O$ [m/m].

After application of a non-metallic, non-combustible, gas-resistant, first barrier coating by dipping or brushing, the combustible carbonaceous heat source may be dried in an oven at about 130° C. for approximately 30 minutes and placed in a desiccator under about 5% relative humidity overnight.

Spray-coating involves a suspension solution, preferably containing 3.6% bentonite, 18.0% kaolinite and 78.4% $H_2O$ [m/m] and having a viscosity of around 50 mPa·s at a shear rate of about 100 $s^{-1}$ as measured with a rheometer (Physica MCR 300, coaxial cylinder arrangement). Spray-coat may be done with a Sata MiniJet 3000 spray gun using spray nozzles of 0.5 mm, 0.8 mm or 1 mm on a SMC E-MY2B linear actuator at a velocity of about 10 mm/s to about 100 mm/s. The following spray parameters may be used: distance sample-pistol 15 cm; sample velocity 10 mm/s; spray nozzle 0.5 mm; spray jet flat and spray pressure 2.5 bar. In a single spray-coating event, a coating thickness of about 11 microns is typically obtained. Spraying is repeated preferably three times. Between each spray-coating, the combustible carbonaceous heat source is dried at room temperature for about 10 minutes. After application of the non-metallic, non-combustible, gas-resistant, first barrier coating, the combustible carbonaceous heat source is preferably pyrolysed at about 700° C. for approximately 1 hour.

EXAMPLE 3

Coating of Combustible Heat Source with Sintered Glass

A non-metallic, non-combustible, gas-resistant, first barrier coating of glass may be provided on the rear face of a combustible carbonaceous heat-source prepared as described in Example 1 by spray-coating. Spray-coating with glass may be performed with a suspension of ground glass using a fine powder. For example, a spray-coating suspension containing either 37.5% glass powder (3 μm), 2.5% methylcellulose and 60% water with a viscosity of 120 mPa·s, or 37.5% glass powder (3 μm), 3.0% bentonite powder, and 59.5% water with a viscosity of 60 to 100 mPa·s, may be used. Glass powder having the compositions and physical properties corresponding to Glass 1, 2, 3 and 4 in Table 2 can be used.

Spray-coating may be done with a Sata MiniJet 3000 spray gun using spray nozzles of 0.5 mm, 0.8 mm or 1 mm on a SMC E-MY2B linear actuator at a velocity of about 10 mm/s to about 100 mm/s. Spraying is preferably repeated several times. After the spraying is completed, the combustible carbonaceous heat source is preferably pyrolysed at about 700° C. for approximately 1 hour.

TABLE 2

Composition of glasses in weight percent, transformation temperature Tg, coefficient of thermal expansion $A_{20\text{-}300}$ and KI-value calculated from composition

| | Glass 1 | Glass 2 | Glass 3 | Glass 4 |
|---|---|---|---|---|
| $SiO_2$ | 70 | 70 | 65 | 60 |
| $Na_2O$ | 20 | 15 | 20 | 20 |
| $K_2O$ | | | | 5 |
| CaO | 10 | 8 | 10 | 10 |
| MgO | | 4 | 5 | 5 |
| $Al_2O_3$ | | 3 | | |
| $T_g$ (° C.) | 517 | 539 | 512 | 465 |
| $A_{20\text{-}300}$ ($10^{-6}$ $K^{-1}$) | 10.9 | 9.3 | 10.2 | 12.1 |
| KI-value | 30 | 21 | 35 | 40 |

EXAMPLE 4

Methods for Measuring Smoke Compounds

Conditions for Smoking

Conditions for smoking and smoking machine specifications are set out in ISO Standard 3308 (ISO 3308:2000). Atmosphere for conditioning and testing are set out in ISO Standard 3402. Phenols are trapped using Cambridge filter pads. Quantitative determination of carbonyls in aerosols, including formaldehyde, acrolein, acetaldehyde and propionaldehyde, is done by UPLC-MSMS. Quantitative measurement of phenolics such as catechol, hydroquinone and phenol is done by LC-fluorescence. Carbon monoxide in the smoke is trapped using gas sampling bags and measured using a non-dispersive infra-red analyzer as set out in ISO Standard 8454 (ISO 8454:2007).

Smoking Regimes

Cigarettes tested under a Health Canada smoking regime are smoked over 12 puffs with a puff volume of 55 ml, puff duration of 2 seconds and a puff interval of 30 seconds. Cigarettes tested under an intense smoking regime are smoked over 20 puffs with a puff volume of 80 ml, a puff duration of 3.5 seconds and puff interval of 23 seconds.

EXAMPLE 5

High Temperature Protection and Reduction of Carbon Monoxide by Back Coating Smoking articles according to the preferred embodiment of the invention shown in FIG. 1 having a total length 70 mm were made by hand. The smoking articles comprised a combustible cylindrical carbonaceous heat source with a single longitudinal airflow channel having an outer diameter of 1.85 mm and a non-metallic, non-combustible, gas-resistant, first barrier coating of clay, made essentially as described in WO 2009/074870 A2 and Example 1. The aerosol-forming substrate of the smoking articles was 10 mm in length and comprised approximately 60% by weight flue-cured tobacco, approximately 10% by weight oriental tobacco and approximately 20% by weight sun-cured tobacco. The heat conducting element of the smoking articles was 9 mm in length, of which 4 mm covered the rear portion of the combustible heat source and 5 mm covered the adjacent front portion of the aerosol-forming substrate. Except as noted in the foregoing description in this Example, the properties of the smoking articles conformed to those listed in Table 1 above. Smoking articles of the same construction, but without a non-metallic, non-combustible, gas-resistant, first barrier coating, were also made by hand for comparison.

The temperature was measured in the aerosol-forming substrate during lighting of the combustible heat source of a smoking article comprising a combustible heat source with a non-metallic, non-combustible, gas-resistant, first barrier coating of clay and a smoking article comprising a combustible heat source without a non-metallic, non-combustible, gas-resistant, first barrier coating. To measure the temperature, a thermocouple was inserted into the aerosol-forming substrate of the smoking articles as disclosed in patent application WO-A2-2009/022232. The results are summarised in FIG. 2 and show that during the first few seconds of ignition of the combustible heat source, the temperature in the aerosol-forming substrate was much lower for the smoking article comprising a combustible heat source with a non-metallic, non-combustible, gas-resistant, first barrier coating of clay (shown by a dotted line in FIG. 2) compared to the smoking article comprising a combustible heat source without a non-metallic, non-combustible, gas-resistant, first barrier coating (shown by a solid line in FIG. 2). The total carbon monoxide delivery of the smoking articles was also was measured under a Health Canada smoking regime. The measured total carbon monoxide delivery for the smoking article comprising a combustible heat source without a non-metallic, non-combustible, gas-resistant, first barrier coating of clay was 1.47 μg. The measured total carbon monoxide delivery for the smoking article comprising a combustible heat source with a non-metallic, non-combustible, gas-resistant, first barrier coating of clay was only 0.97 μg. Provision of a non-metallic, non-combustible, gas-resistant, first barrier coating of clay on the rear face of the combustible heat source thus resulted in approximately a 35% reduction in total carbon monoxide delivery.

EXAMPLE 6

Preparation of Combustible Heat Source with Ignition Aid

A carbonaceous combustible heat source comprising an ignition aid may be prepared by mixing 525 g of carbon powder, 225 g of calcium carbonate ($CaCO_3$), 51.75 g of potassium citrate, 84 g of modified cellulose, 276 g of flour, 141.75 g of sugar and 21 g of corn oil with 579 g of deionised water to form an aqueous slurry, essentially as disclosed in WO2009/074870 A2. The aqueous slurry may then be extruded through a die having a central die orifice of circular cross-section with a diameter of about 8.7 mm to form cylindrical rods having a length of between about 20 cm and about 22 cm and a diameter of between about 9.1 mm and about 9.2 mm. A single longitudinal airflow channel may be formed in the cylindrical rods by a mandrel mounted centrally in the die orifice. The mandrel preferably has a circular cross-section with an outer diameter of approximately 2 mm or approximately 3.5 mm. Alternatively, three airflow channels may be formed in the cylindrical rods using three mandrels of circular cross-section with an outer diameter of approximately 2 mm mounted at regular angles in the die orifice. During extrusion of the cylindrical rods, a green clay-based coating slurry may be pumped through a feed passageway extending through the centre of the mandrel to form a thin second barrier coating having a thickness of between about 150 microns and about 300 microns on the inner surface of the single longitudinal airflow channel. The cylindrical rods are preferably dried at between about 20° C. and about 25° C. under about 40% to about 50% relative humidity for between approximately 12 hours and approximately 72 hours and then pyrolysed in a nitrogen atmosphere at about 750° C. for approximately 240 minutes. After pyrolysis, the cylindrical rods may be cut and shaped to a defined diameter using a grinding machine to form individual combustible-carbonaceous heat sources having a length of about 11 mm, a diameter of about 7.8 mm, and a dry mass of about 400 mg. The individual combustible carbonaceous heat sources may then be dried at about 130° C. for approximately 1 hour and then placed in an aqueous solution of nitric acid having a concentration of 38 percent by weight and saturated with potassium nitrate ($KNO_3$). After approximately 5 minutes, individual combustible carbonaceous heat sources are preferably removed from the solution and dried at about 130° C. for approximately 1 hour. After drying the individual combustible carbonaceous heat sources may be placed once again in an aqueous solution of nitric acid having a concentration of 38 percent by weight and saturated with potassium nitrate ($KNO_3$). After approximately 5 minutes, the individual combustible carbonaceous heat sources may be removed from the solution and dried at about 130° C. for approximately 1 hour, followed by drying at about 160° C. for approximately 1 hour and finally drying at about 200° C. for approximately 1 hour.

EXAMPLE 7

Smoke Compounds from Smoking Articles with Combustible Heat-Sources with a Non-Combustible, Gas-Resistant, First Barrier Coating of Clay or Glass Combustible cylindrical carbonaceous heat sources comprising an ignition aid prepared as described in Example 6 with a single longitudinal airflow channel having a diameter of 1.85 mm and a bentonite/kaolinite second barrier coating, were provided with a non-metallic, non-combustible, gas-resistant, first barrier coating of clay as described in Example 2. Additionally, combustible cylindrical carbonaceous heat sources comprising an ignition aid as described in Example 6 with a single longitudinal airflow channel having a diameter of 1.85 mm and a glass second barrier coating, were provided with a non-metallic, non-combustible, gas-resistant, first barrier coating of sintered glass as described in Example 3. In both cases, the length of the combustible cylindrical carbonaceous heat sources was 11 mm. The non-metallic, non-combustible, gas-resistant, first barrier coating of clay preferably has a thickness of between about 50 microns or about 100 microns and the non-metallic, non-combustible, gas-resistant, first barrier coating of glass preferably has a thickness of about 20 microns, about 50 microns or about 100 microns. Smoking articles according to the preferred embodiment of the invention shown in FIG. 1 having a total length of 70 mm comprising the aforementioned combustible cylindrical carbonaceous heat sources were assembled by hand. The aerosol-forming substrate of the smoking articles was 10 mm in length and comprised approximately 60% by weight flue-cured tobacco, approximately 10% by weight oriental tobacco and approximately 20% by weight sun-cured tobacco. The heat conducting element of the smoking articles was 9 mm in length, of which 4 mm covered the rear portion of the combustible heat source and 5 mm covered the adjacent front portion of the aerosol-forming substrate. Except as noted in the foregoing description in this Example, the properties of the smoking articles conformed to those listed in Table 1 above. Smoking articles of the same construction, but without a non-metallic, non-combustible, gas-resistant, first barrier coating, were also made by hand for comparison.

The resulting smoking articles were smoked as described in Example 5 under a Health Canada smoking regime. Before smoking, the combustible heat sources of the smoking articles were lit using a regular yellow flame lighter. The formaldehyde, acetaldehyde, acrolein and propionaldehyde in the mainstream aerosol of the smoking articles was measured as described in Example 5. The results are summarised in Table 3 below and show that carbonyls, such as acetaldehyde and especially formaldehyde, are significantly reduced in the mainstream aerosols of smoking articles comprising a combustible heat source with a non-metallic, non-combustible, gas-resistant, first barrier coating compared to the mainstream aerosols of smoking articles comprising a combustible heat source without a non-metallic, non-combustible, gas-resistant, first barrier coating.

Example 5 above demonstrates the reduction of carbon monoxide by one embodiment of the invention. As can be seen from Example 7, providing a non-metallic, non-combustible, gas-resistant, first barrier coating on substantially the entire rear face of the combustible heat source according to the invention also surprisingly results in significantly reduced formation of carbonyl compounds, such as formaldehyde, acetaldehyde, proprionaldehyde and phenolics, in the mainstream aerosol. The Examples described above illustrate but do not limit the invention. Other embodiments of this invention may be made without departing from the spirit and scope thereof, and it is to be understood that the specific Examples and embodiments described herein are not limiting.

TABLE 3

Amount of carbonyls (micrograms per sample) measured in mainstream aerosol under Health Canada smoking regime for smoking articles comprising a combustible carbonaceous heat source (a) without a non-metallic, non-combustible, gas-resistant, first barrier coating, (b) with a non-metallic, non-combustible, gas-resistant, first barrier coating of clay and (c) with a non-metallic, non-combustible, gas-resistant, first barrier coating of sintered glass.

| Non-combustible, gas-resistant, first barrier coating | (a) None | (b) Clay | | (c) Glass | | |
|---|---|---|---|---|---|---|
| Thickness (microns) | | 50 | 100 | 20 | 50 | 100 |
| formaldehyde | 22.19 | 18.2 | 17.6 | 14.87 | 12.99 | 14.56 |
| acetaldehyde | 102.83 | 103.9 | 89.4 | 75.11 | 69.56 | 86.89 |
| acrolein | 7.09 | 7.7 | 7.1 | 6.22 | 4.29 | 5.41 |

TABLE 3-continued

Amount of carbonyls (micrograms per sample) measured in mainstream aerosol under Health Canada smoking regime for smoking articles comprising a combustible carbonaceous heat source (a) without a non-metallic, non-combustible, gas-resistant, first barrier coating, (b) with a non-metallic, non-combustible, gas-resistant, first barrier coating of clay and (c) with a non-metallic, non-combustible, gas-resistant, first barrier coating of sintered glass.

| Non-combustible, gas-resistant, first barrier coating | (a) None | (b) Clay | | (c) Glass | | |
|---|---|---|---|---|---|---|
| Thickness (microns) | | 50 | 100 | 20 | 50 | 100 |
| propionaldehyde | 5.09 | 4.9 | 7.7 | 4.50 | 3.64 | 4.78 |

The invention claimed is:

1. A smoking article, comprising:

a combustible heat source with opposed front and rear faces and at least one airflow channel extending from the front face to the rear face of the combustible heat source; and an aerosol-forming substrate comprising at least one aerosol former downstream of the combustible heat source, wherein a non-metallic, non-combustible, gas-resistant, first barrier coating is provided on substantially all of the rear face of the combustible heat source, which allows gas to be drawn through the at least one airflow channel, and wherein the non-metallic, non-combustible, gas-resistant, first barrier coating has a combined elemental metal and alloy content of less than 50 mole percent.

2. The smoking article according to claim 1, wherein the first barrier coating has a thickness of at least about 10 microns.

3. The smoking article according to claim 2, wherein the first barrier coating is substantially impermeable to air.

4. The smoking article according to claim 1, wherein the first barrier coating comprises clay, glass, or alumina.

5. The smoking article according to claim 1, wherein the combustible heat source is a carbonaceous heat source.

6. The smoking article according to claim 1, wherein the combustible heat source comprises an ignition aid.

7. The smoking article according to claim 6, wherein the ignition aid is an oxidizing agent.

8. The smoking article according to claim 1, wherein a gas-resistant, heat resistant, second barrier coating is provided on an inner surface of the at least one airflow channel.

9. The smoking article according to claim 8, wherein the second barrier coating is substantially impermeable to air.

10. The smoking article according to claim 1, wherein the aerosol-forming substrate comprises homogenised tobacco-based material.

11. The smoking article according to claim 1, further comprising:

a heat-conducting element around and in contact with a rear portion of the combustible heat source and an adjacent front portion of the aerosol-forming substrate.

12. The smoking article according to claim 1, further comprising:

an expansion chamber downstream of the aerosol-forming substrate.

13. The smoking article according to claim 12, further comprising:

a mouthpiece downstream of the expansion chamber.

14. A combustible heat source with opposed front and rear faces for use in a smoking article, the combustible heat source comprising:

at least one airflow channel extending from the front face to the rear face of the combustible heat source; and a non-metallic, non-combustible, gas-resistant, barrier coating on substantially all of the rear face of the combustible heat source, which allows gas to be drawn through the at least one airflow channel, wherein the non-metallic, non-combustible, gas-resistant, first barrier coating has a combined elemental metal and alloy content of less than 50 mole percent.

* * * * *